US005603304A

United States Patent [19]

Matczak

[11] Patent Number: 5,603,304

[45] Date of Patent: Feb. 18, 1997

[54] FUEL PUMP SEAL AND INSULATOR ASSEMBLY

[75] Inventor: Stanley E. Matczak, Ellington, Conn.

[73] Assignee: Seals-It, East Hartford, Conn.

[21] Appl. No.: 594,993

[22] Filed: Jan. 31, 1996

[51] Int. Cl.[6] ..... F02M 37/04

[52] U.S. Cl. ..... 123/509; 277/235 B

[58] Field of Search ..... 123/495, 509; 277/235 B

[56] References Cited

U.S. PATENT DOCUMENTS

| | | | |
|---|---|---|---|
| 1,963,658 | 6/1934 | Ford | 123/509 |
| 2,104,448 | 1/1938 | Babitch et al. | 123/509 |
| 4,508,072 | 4/1985 | Takami et al. | 277/235 B |
| 4,917,069 | 4/1990 | Kuhlen | 123/509 |

*Primary Examiner*—Thomas N. Moulis
*Attorney, Agent, or Firm*—Fishman, Dionne & Cantor

[57] ABSTRACT

A fuel pump insulator assembly is mounted on a fuel pump. The fuel pump insulator assembly comprises insulating fasteners, an insulating gasket and a seal. The insulating gasket provides a thermal barrier between an engine and a fuel pump, whereby heat from the engine is not transferred to the fuel pump. The seal seals the fuel pump from the engine, whereby hot engine oil is not allowed to splash into the fuel pump. The insulating fasteners reduce heat transfer from the engine through the fasteners to the fuel pump. The insulating fasteners each comprise a elongated cylindrical body portion having an opening longitudinally therethrough with an insulating washer disposed at one end thereof. The insulating gasket has opposing flange portions which depend from a main portion with an elongated opening therethrough. The seal comprises a flange mounting seal portion with a fuel arm seal portion depending therefrom. The flange mounting seal portion has opposing flange portions which depend from a main portion with an opening therethrough. The fuel arm seal portion depends from the flange mounting seal portion and includes an opening or flap through which the fuel pump arm of the fuel pump passes.

18 Claims, 2 Drawing Sheets

FUEL PUMP SEAL AND INSULATOR ASSEMBLY

BACKGROUND OF THE INVENTION

The present invention relates generally to mechanical fuel pumps. More specifically, the present invention relates to a fuel pump insulator assembly that insulates the fuel pump from engine heat and seals the fuel pump from hot engine oil.

Internal combustion engines using liquid fuels make use of fuel pumps to transfer fuel from fuel storage areas or a fuel tank to the engine's carburetor(s) or fuel injector(s). Fuel pumps are powered electrically or mechanically, with mechanical fuel pumps being powered or driven through being mechanically connected to the engine. Fuel lines connect the fuel tank to the fuel pump, and the fuel pump to the carburetor(s) or injector(s).

Mechanical fuel pumps typically have an enclosed fuel chamber, an inlet valve, an outlet valve, a flexible diaphragm, an arm, and a body on which the fuel chamber is mounted and which provides mounts for the arm. The diaphragm forms a portion of the wall of the fuel chamber, which is otherwise rigid and made of metal or other appropriate material. Fuel enters and exits the fuel chamber through inlet and outlet valves, respectively. The inlet and outlet valves are one-way, with the inlet valve allowing fuel into the chamber but not out, and the outlet valve allowing fuel out of the chamber but not in. Fuel is transferred from the tank to the fuel chamber when the diaphragm is flexed so as to increase the volume of the chamber, creating a pressure differential between the chamber and the tank thus drawing fuel into the chamber. The diaphragm is then flexed in the opposite direction, decreasing the volume of the chamber thereby and forcing fuel out through the outlet valve. The fuel is thus delivered under pressure to the engine. The fuel pump arm is connected to the center of the diaphragm and moves the diaphragm towards and away from the fixed portions of the fuel chamber as it reciprocates. The fuel pump arm rocks on a pivot pin that rotatably passes through pivot holes located perpendicularly to the arm's length, and where the pivot pin has a length longer than the width of the arm and the pivot pin's ends are solidly located in pivot pin mounts which are located inside the pump body cavity. The end of the fuel pump arm located outside the fuel pump body cavity is driven by the engine, typically by the camshaft, in a reciprocating motion which is transferred to the diaphragm as reciprocating motion by virtue of rocking on the pivot pin.

Mechanical fuel pump mounting components generally consist of holes molded or drilled in the fuel pump body through which bolts or studs pass, threading into the engine block or head. The engine block or head is normally machined flat on its exterior surface around the area where the bolts or studs are received, with an opening proximately located allowing the fuel pump arm to extend into the interior of the engine block or head. This area of the engine block or head is known as the engine's fuel pump mounting pad.

The fuel pump arm, passing through the opening in the mounting pad, engages the mechanism internal to the engine block or head which moves the arm in its reciprocating motion. The opening in the mounting pad for the fuel pump arm must be large enough to allow the arm to move through its entire reciprocating motion without interference. Additionally, the opening must be designed to accommodate the installation and removal of the fuel pump, where installation and removal involves the need for the fuel pump arm to be moved vertically, horizontally, and axially as the fuel pump and its arm are moved into their final mounted position around internal and external mechanical obstacles. In some engines, internal actuating mechanism parts must be simultaneously installed with the fuel pump. The opening must also accommodate the end of the arm that contacts the internal mechanism, which is sometimes a machined portion of a flat pad that is larger in cross-section than the rest of the arm. As a result of the considerations just discussed, the mounting pad opening is substantially larger than the external dimensions of the fuel pump arm itself.

The fuel pump body has an ovoid location for the diaphragm and fuel chamber to be mounted. The fuel pump arm pivot mount and ovoid fuel chamber mount are in the interior of the fuel pump body. As discussed above, the fuel pump arm rocks on a pivot pin mounted in a pivot mount in the interior of the fuel pump body, transferring the reciprocating motion from the end of the arm in contact to an internal engine mechanism to the end of the arm inside the fuel pump appended to the diaphragm. The diaphragm has two surfaces, with the surface appended to the fuel pump arm forming part of the fuel pump body internal cavity. The fuel pump body internal cavity, including the surface of the diaphragm appended to the fuel pump arm, forms a contiguous open area with the internal portion of the engine that contains the circulating engine oil when the fuel pump is mounted on an engine.

A gasket is usually fitted between the fuel pump body and the engine mounting pad. The gasket is shaped to fit around the fasteners and around the exterior of the mounting pad opening. The gasket allows heat to be freely transferred from the engine to the fuel pump and only serves to prevent oil leakage at the joint therebetween.

Some manufacturers install a simple insulator between the fuel pump body and the mounting pad when fuel overheating becomes a design concern. Design factors taken into consideration include the fuel pump's location on the engine, where intake and exhaust manifolds are to be located, the location of fuel lines in the engine compartment, where and how the fuel pump and engine assembly is to be mounted for use, and how the engine will actually be used in service. Such an insulator is typically made of a single substance such as fiber or plastic, is flat and relatively thin (usually less than ⅛"), and is cut to a shape that is substantially similar to that of the gasket just discussed, following the outer edge of the mounting pad opening. The insulator is mounted between the mounting pad and the fuel pump body with a gasket or appropriate sealer on each of its flat surfaces. The total thickness of the insulator and gaskets must be kept within specified engineering tolerances to allow the fuel pump arm to properly engage the mechanism which moves the fuel pump arm in a reciprocating motion. The contiguous cavity formed by the inside of the fuel pump body and the inside of the engine is not affected with this type of insulator.

A consequence of using the mounting components and methods described above is that considerable heat is passed into the fuel pump. The heated fuel pump then heats the fuel as the fuel is being pumped, creating numerous problems. As the fuel approaches its vaporization point, it will display highly variable and localized temperature and pressure differentials which cause numerous tuning and running problems. Power drops off, fuel consumption rises, emissions rise, and the engine runs roughly. As the fuel temperature continues to rise, engine performance degrades until the fuel vaporizes, causing vapor lock. The engine will then stop running and can be very difficult to restart as the fuel pump and the surrounding fuel lines must cool to the point where the fuel again becomes liquid, often involving a significant wait.

There are three primary ways in which heat is passed to the fuel pump assembly when the mounting components and methods discussed above are used to mount a mechanical fuel pump. One is through the mounting pad when a standard insulator is not used, one is from the mounting pad through the mounting fasteners to the fuel pump body, and one is from hot engine oil impinging directly into the interior of the fuel pump body and onto the diaphragm. When using the currently available insulator with gaskets or sealers, heat continues to be transferred to the fuel pump body from the mounting pad through the mounting fasteners and from hot engine oil contacting the interior of the fuel pump body and the diaphragm. Use of the industry standard insulator somewhat reduces the frequency with which vapor lock occurs, and somewhat increases the temperature at which the engine and can operate without vaporizing the fuel. However, with the continued direct exposure of the fuel pump body to the hot engine oil and the heat coming through the mounting fasteners, the protection offered by the standard insulator against heating and vaporization is not enough in hot climates nor under heavy use. In racing applications the standard insulator is inadequate, where it is normal for racing vehicles to experience rough running and power loss due to fuel overheating and to stall and experience difficulty restarting due to vaporization.

SUMMARY OF THE INVENTION

The above-discussed and other drawbacks and deficiencies of the prior art are overcome or alleviated by the fuel pump insulator assembly of the present invention. In accordance with the present invention, the fuel pump insulator assembly is mounted on a fuel pump. The fuel pump insulator assembly comprises insulating fasteners, an insulating gasket and a seal. In accordance with an important features of the present invention, the insulating gasket provides a thermal barrier between an engine and a fuel pump, whereby heat from the engine is not transferred to the fuel pump. In accordance with another important feature of the present invention, the seal seals the fuel pump from the engine, whereby hot engine oil is not allowed to splash into the fuel pump. Also, the insulating fasteners reduce heat transfer from the engine through the fasteners to the fuel pump.

The insulating fasteners each comprise a elongated cylindrical body portion having an opening longitudinally therethrough with an insulating washer disposed at one end thereof. The insulating gasket has opposing flange portions which depend from a main portion with an elongated opening therethrough. The insulating gasket has a profile which generally follows that of a mounting flange of the fuel pump to which it is to be mounted.

The seal comprises a flange mounting seal portion with a fuel arm seal portion depending therefrom. The flange mounting seal portion has opposing flange portions which depend from a main portion with an opening therethrough. The flange mounting seal portion has a profile which generally follows that of the insulating gasket and, therefore, it has a profile which generally follows that of the mounting flange of the fuel pump to which it is to be mounted. The fuel arm seal portion depends from the flange mounting seal portion and includes an opening or flap through which the fuel pump arm of the fuel pump passes.

The above-discussed and other features and advantages of the present invention will be appreciated and understood by those skilled in the art from the following detailed description and drawings.

BRIEF DESCRIPTION OF THE DRAWING

Referring now to the drawings wherein like elements are numbered alike in the several FIGURES.

DESCRIPTION OF THE PREFERRED EMBODIMENT

Figure 1:
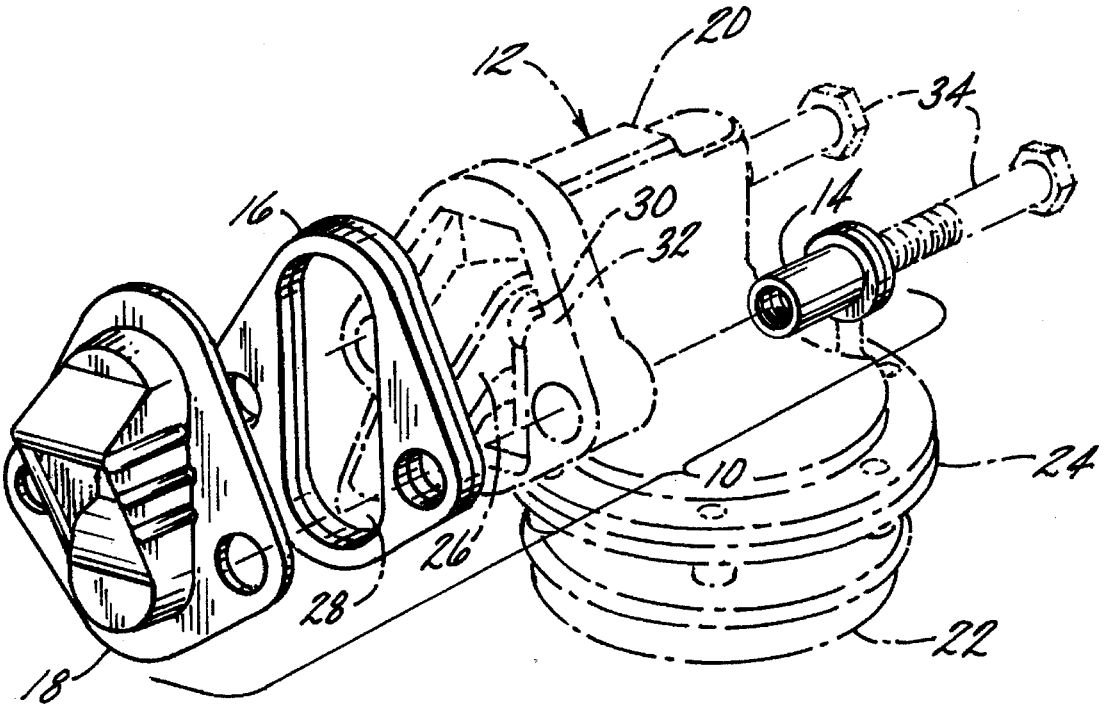
FIG. 1 is an exploded perspective view of a fuel pump insulator assembly mounted on a fuel pump in accordance with the present invention.

Referring to FIG. 1, a fuel pump insulator assembly 10 in accordance with the present invention is mounted on a fuel pump 12. Fuel pump insulator assembly 10 comprises insulating fasteners 14, an insulating gasket 16 and a seal 18. Fuel pump 12 comprises a fuel pump body 20 mounted on a fuel bowl 22 with a diaphragm 24 disposed therebetween, as is well known in the art. A fuel chamber is defined in fuel bowl 22 below diaphragm 24. A fuel pump arm 26 has a contact pad 28 at one end thereof and is attached to about the center of diaphragm 24 at the other end thereof. Fuel pump arm 26 pivots about a pin 30 which attaches arm 26 to body 20. Fuel pump 12 is mounted to an engine (not shown) at a mounting flange 32 with insulating gasket 16 and seal 18 disposed therebetween by fasteners 34, whereby fuel pump arm 26 is driven by the engine as is well known.

In accordance with an important features of the present invention, insulating gasket 16 provides a thermal barrier between the engine and fuel pump 12, whereby heat from the engine is not transferred to the fuel pump. In accordance with another important feature of the present invention, seal 18 seals fuel pump 12 from the engine, whereby hot engine oil is not allowed to splash into fuel pump 12. Also, insulating fasteners 14 reduce heat transfer from the engine through fasteners 34 to fuel pump 12.

Figure 2:
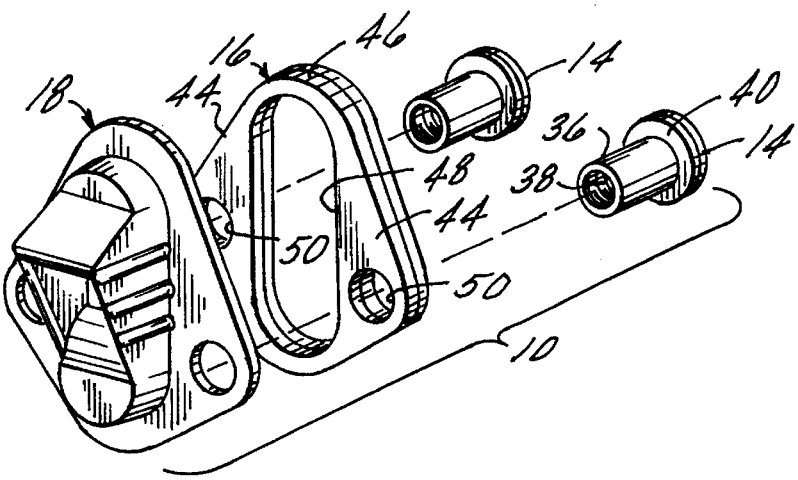
FIG. 2 is an exploded perspective view of the fuel pump insulator assembly of FIG. 1.

Referring to FIG. 2, an exploded perspective view of fuel pump insulator assembly 10 is generally shown. Insulating fasteners 14 each comprise a elongated cylindrical body portion 36 having an opening 38 longitudinally therethrough with an insulating washer 40 disposed at one end thereof. Insulating gasket 16 has opposing flange portions 44 which depend from a main portion 46 with an elongated opening 48 therethrough. Insulating gasket 16 has a profile which generally follows that of mounting flange 32 of the fuel pump to which it is to be mounted. A mounting hole 50 extends through gasket 16 at each flange portion 44. Insulating fasteners 14 and insulating gasket 16 are comprised of a material suitable for thermally insulating, e.g., fiberglass or a suitable composite material.

Figure 3:
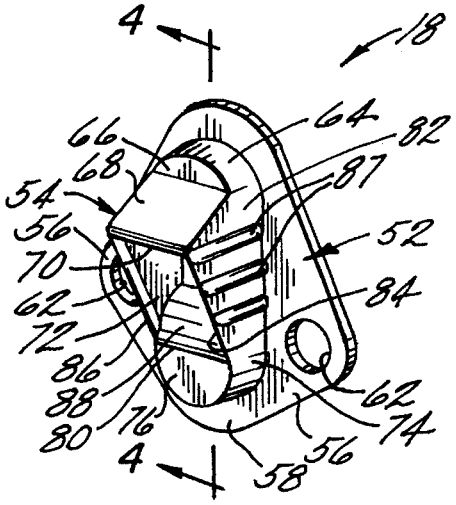
FIG. 3 is a perspective view of a seal of the fuel pump insulator assembly of FIG. 1.
Figure 4:
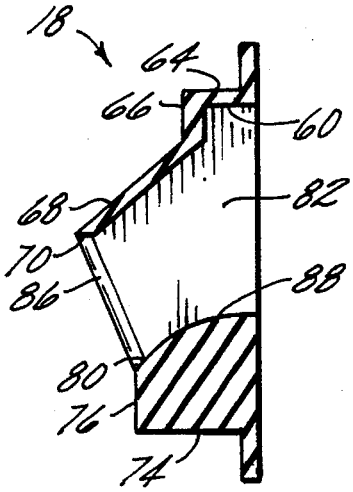
FIG. 4 is a cross sectional view taken along the line 4—4 in FIG. 3.

Referring to FIGS. 3 and 4, seal 18 comprises a flange mounting seal portion 52 with a fuel arm seal portion 54 depending therefrom. Portion 52 has opposing flange portions 56 which depend from a main portion 58 with an opening 60 therethrough. Portion 52 has a profile which generally follows that of gasket 16 and, therefore, it has a profile which generally follows that of mounting flange 32 of the fuel pump to which it is to be mounted. A mounting hole 62 extends through gasket portion 52 at each flange portion 56 and aligns with corresponding mounting hole 50 in gasket 16 when disposed thereon. Fuel arm seal portion 54 depends from portion 52 at opening 60. Portion 54 comprises an upper arcuate wall 64 depending outwardly from portion 52 which terminates at a raised ledge 66. A member 68 extends outwardly from ledge 66 at one end thereof and defines a first side 70 of a generally rectangular opening 72 at the other end thereof. A lower arcuate wall 74 depends outwardly from portion 52 and terminates at a raised ledge 76. The other end of ledge 76 defines a second side 80 of opening 72, the second side being opposite the first side. Opposing side walls 82 depend outwardly from portion 52 between upper and lower arcuate walls 64 and 74, respectively, and terminate at respective sides of member 68 and define corresponding third and fourth sides 84 and 86, respectively, of opening 72. A plurality of ribs 87 depend outwardly from side walls 82 to define the rigidity thereof. An arcuate surface 88 depends inwardly from ledge 76 at side 80 of opening 72. Surface 88 generally follows the curvature of the fuel pump arm 26, however it is position so as not to interfere the working movement of the arm. It will be appreciated that various thicknesses are selected for different portions of the seal to determine the flexibility of those portions, as is well known in the art. Further, seal 18 is comprised of a material having the dynamic action, durability, and other properties required (e.g., suitable for prolonged exposure to high temperatures), such materials include, e.g., polymers such as nitrile or neoprene, plastics and other seal materials (e.g., rubber).

Although described herein as separate components, it is within the scope of the present invention that fuel arm seal portion 54 be mounted (by, e.g., adhesive bonding, chemical bonding, fused together or a mechanical means of attachment) directly on gasket 16 at opening 48, whereby portion 54 and gasket 16 would be comprised of different materials, such as described herein. Further, lubricant for lubricating the fuel arm at its pivot point may be provided at the fuel pump side of the seal, whereby the lubricant is maintained therein by the seal.

Figure 5:
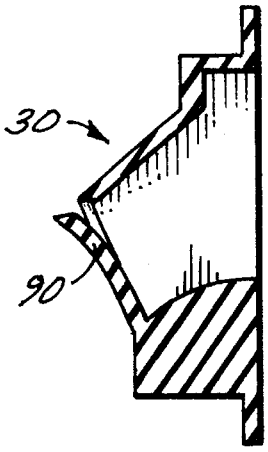
FIG. 5 is a cross sectional view taken along the line 4—4 in FIG. 3 in accordance with an alternate embodiment of the present invention.

Referring to FIG. 5, in accordance with an alternate embodiment of the present invention a flap 90 depends upwardly from ledge 76 at side 80 of opening 72 closing off opening 72. Flap 90 in the closed position is defined by an inverted U-shaped slot through which the fuel pump arm extends. Further, flap 90 is sufficiently flexible so as not to interfere with the working movement of the fuel arm.

The fuel pump insulator assembly of the present invention reduces delivered fuel temperature an average of 15°–20° F., whereby fuel is generally not vaporized at the fuel pump and lower temperature delivered fuel results in more efficient engine operations.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A seal comprising:

a flange portion having a first opening therethrough; and a seal portion depending outwardly from said flange portion at about said first opening, said seal portion including opposing side walls depending outwardly from said flange portion and terminating at an outer member, said side walls and said outer member defining a second opening through said seal portion.

2. The seal of claim 1 wherein said seal portion further comprises:

an upper arcuate wall depending outwardly from said flange portion;

a first ledge disposed at said upper arcuate wall, said outer member depending from said first ledge;

a lower arcuate wall depending outwardly from said flange portion; and a second ledge disposed at said lower arcuate wall, said second opening being defined by said second ledge, said side walls and said outer member.

3. The seal of claim 1 wherein said seal portion further comprises:

a plurality of ribs depending from said side walls.

4. The seal of claim 1 further comprising;

an arcuate surface depending inwardly from said second opening in between said side walls.

5. The seal of claim 1 further comprising:

a flap disposed at said second opening.

6. The seal of claim 1 wherein said flange portion further comprises:

at least one mounting hole therethrough.

7. The seal of claim 1 comprised of a polymer.

8. An assembly for thermally insulating a fuel pump from an engine, the fuel pump having a mounting flange and a fuel pump arm, the assembly comprising:

a thermal insulating gasket having a gasket opening therethrough; and a seal disposed on said insulating gasket, said seal and said insulating gasket for mounting between the mounting flange of the fuel pump and the engine, said seal having a seal opening therethrough, said seal opening being in general alignment with said gasket opening, said seal opening receptive to the fuel pump arm and for sealingly engaging the fuel pump arm.

9. The assembly of claim 8 further comprising:

insulating fasteners disposed at fasteners of the fuel pump for thermally insulating the fasteners of the fuel pump from the fuel pump.

10. The assembly of claim 8 wherein said seal comprises:

a flange portion having a flange opening therethrough; and a seal portion depending outwardly from said flange portion at about said flange opening, said seal portion including opposing side walls depending outwardly from said flange portion and terminating at an outer member, said side walls and said outer member defining said seal opening.

11. The assembly of claim 10 wherein said seal portion further comprises:

an upper arcuate wall depending outwardly from said flange portion;

a first ledge disposed at said upper arcuate wall, said outer member depending from said first ledge;

a lower arcuate wall depending outwardly from said flange portion; and a second ledge disposed at said lower arcuate wall, said seal opening being defined by said second ledge, said side walls and said outer member.

12. The assembly of claim 10 wherein said seal portion further comprises:

a plurality of ribs depending from said side walls.

13. The assembly of claim 10 further comprising;

an arcuate surface depending inwardly from said seal opening in between said side walls.

14. The assembly of claim 10 further comprising:

a flap disposed at said seal opening.

15. The assembly of claim 10 wherein:

said gasket includes at least one mounting hole therethrough; and said flange portion of said seal includes at least one mounting hole therethrough, said at least one mounting hole of said gasket being aligned with said at least one mounting hole of said flange portion of said seal.

16. The assembly of claim 8 wherein said seal is comprised of a polymer.

17. A fuel pump mounted on an engine, the fuel pump having a fuel pump arm, wherein the improvement comprises;

a seal disposed between the fuel pump and the engine, said seal sealingly engaging the fuel pump arm passing therethrough.

18. The fuel pump mounted on the engine of claim 17, wherein the improvement further comprises:

a thermal insulating gasket disposed with said seal between the fuel pump and the engine.

* * * * *